US005327985A

United States Patent [19]

Porzilli

[11] Patent Number: 5,327,985

[45] Date of Patent: * Jul. 12, 1994

[54] ACOUSTICAL TRANSDUCER ENCLOSURE

[76] Inventor: Louis Porzilli, 164 W. Shore Trail, Sparta, N.J. 07871

[ * ] Notice: The portion of the term of this patent subsequent to Sep. 12, 2010 has been disclaimed.

[21] Appl. No.: 801,381

[22] Filed: Dec. 2, 1991

[51] Int. Cl.[5] ..... G10K 11/00

[52] U.S. Cl. ..... 181/177; 181/184; 181/187; 181/194; 181/199; 181/155

[58] Field of Search ..... 181/0.5, 154, 155, 177, 181/184, 186, 187, 188, 192, 194, 198, 199, 296

[56] References Cited

U.S. PATENT DOCUMENTS 3,532,182 10/1970 Bouyoucos ..... 181/0.5
3,982,142 9/1976 Goble ..... 181/0.5
4,344,504 8/1982 Howze ..... 181/187
4,836,328 6/1989 Ferralli ..... 181/155

*Primary Examiner*—J. Woodrow Eldred
*Attorney, Agent, or Firm*—Richard T. Laughlin

[57] ABSTRACT

The present invention relates to an acoustical transducer enclosure which is particularly adapted for directing sound waves and is housed in a multisided enclosure. The enclosure has a cylindrical hollow tube, held in position by a pair of forward baffles, with a speaker housed within. Forward wave guides line the interior area of the enclosure. A wave form vent is located on a horizontal plane with the speaker at one end of the cylindrical hollow tube. A rear back pressure booster baffle is located at the end of the cylindrical hollow tube with a wave splitter which is located proximate the rear back pressure booster.

17 Claims, 1 Drawing Sheet

ACOUSTICAL TRANSDUCER ENCLOSURE

FIELD OF THE INVENTION

This invention relates to an frequency acoustical transducer enclosure which boosts and directs sound waves, particularly those under 90 cycles, to provide optimum bass control.

BACKGROUND OF THE INVENTION

Commercial sound systems for concerts are expected to obtain a quality substantially beyond home systems and are therefore extremely high priced. One problem which continues, despite the high price, is low frequency degradation and low frequency reverberation in confined spaces due to dispersion, especially in the bass waves which can directly result in low frequency feedback.

Bass waves are extremely inefficient and are subject to the greatest loss and dispersion in comparison to mid and high range frequencies.

A significant limitation of the current state of the art acoustic transducers has been their frequency dependent beamwidth. The beamwidth of compression drivers, as well as more conventional transducers, is a function of both the size of the vibrating element and the transducer size, in the case of conventional transducers or the exit dimension and the frequency of vibration, in the case of compression drivers. Compression drivers make use of an acoustic impedance matching device in the shape of a horn attached to the exit of the driver. This device partially controls the beamwidth as well as improves efficiency. Although this solution greatly improves efficiency, it only partially resolves the beamwidth frequency dependence. Other compression drivers attempt to reduce frequency dependence by resorting to very small compression driver exits, however this reduces transducer efficiency.

Recently, a transducer system appeared in the state of the art which controls beamwidth dependence through use of an enclosure which is shaped as the envelope of ellipsoids. The enclosure has radially oriented distinct focal points as well as a common focal point. Transducers placed at the distinct focal points will have their acoustic radiation focused at the common focal point and provided that the ellipsoids have essentially identical path lengths from distinct focal point to ellipsoid to common focal point, their acoustic energy will be coupled in phase. Further, the beamwidth of this device is wide and essentially frequency independent. The device, however, displays a radial interference pattern when the acoustic radiation of the transducers, located on the radially distributed distinct focal points, interact. Specifically, transducers on neighboring distinct focal points can destructively interfere with each other, thereby causing radial diffraction or combing in the acoustic radiation field.

Another transducer system which has appeared in the state of the art overcomes the radial interference problem by use of an acoustic reflective lens. The lens shape is produced when a section of an ellipse is revolved about a line which passes through one of the focal points of the ellipse at some finite angle with respect to the ellipse major axis. In one embodiment, the lens is shaped like that of a cone, the sides of which are concave and describe a continuum of sections of identical ellipses. One focal point, common to all the ellipses, is positioned directly above the apex of the cone while the other focal points of the ellipses describe a circle around the base of the cone. A transducer placed at the common focal point, facing the apex, will have its radiation reflected from the cone surface and, owing to the elliptical shape of the sides of the cones, focused coherently onto the focal circle referred to above. The focal circle will appear as a virtual source of coherent acoustical radiation which, due to the symmetry of the cone, will emanate equally from the base of the cone. The beamwidth of acoustical radiation perpendicular to the base of the cone is controlled by the elliptical shape of the sides of the cone. Two such cones, with accompanying transducers, may be placed base-to-base in order to produce a radiation pattern who horizontal beamwidth is 360 degrees and who vertical beamwidth is frequency invariant.

A limitation of this reflective lens exists that is due to the use of the elliptical geometry. This geometry constrains radiation to emanate, or appear to emanate, from the common focal point of the acoustic lens in order to be coherently focused onto the focal circle. Currently available transducers do not produce such radiation and thus the radiation pattern from this acoustically reflective lens will be somewhat incoherent and may exhibit interference due to this constraint.

U.S. Pat. No. 4,836,328 to Ferralli, provides a geometrically shaped reflective lens for a transduction element such that all acoustic path lengths from the transduction element surface to the lens focal element are substantially identical. A geometrically shaped reflective lens, is also provided, which will focus acoustic waves produced by the transduction element to a focal element which is characteristic of the lens, as well as increase the beamwidth of the acoustic radiation emanating from the lens and provide for the relative consistency of the beamwidth as a function of acoustic wave frequency. The Ferralli patent utilizes a multiple transducer and an elliptical shaped back box. The transducer cone is placed forward into the apex of the ellipsoid and is subject to comb filtering. The Ferralli also does not provide a complex baffling and wave guide system.

This invention utilizes multiple transducers and places the transducer cone forward into the apex of the ellipsoid and is subject to comb filtering. This invention does not use a complex baffling and wave guide system and has not been tested free field.

None of the prior art patents have, however, overcome the problem of diverse bass waves. The instant invention can be produced with the elliptical shaped backbox which is a common design, however, all the other complex baffling and wave guides must be employed in order to achieve directionality under 90 cycles. The increased directionality provided by the instant device promotes cleaner sound with less room reverberation and low frequency feedback than omnidirectional oriented bass enclosure designs due to the popular theoretical misconception that bass waves can not be made directional under 90 cycles.

SUMMARY OF THE INVENTION

The present invention relates to an acoustical transducer enclosure which is particularly adapted for directing sound waves and housed in a multisided enclosure. The enclosure has a cylindrical hollow tube, held in position by a pair of forward baffles, with a speaker housed within. Forward wave guides line the interior area of the enclosure. A wave form vent is located on a horizontal plane with the speaker at one end of the cylindrical hollow tube. A rear back pressure booster baffle is located at the end of cylindrical hollow tube with a wave splitter which located proximate the rear back pressure booster.

BRIEF DESCRIPTION OF THE DRAWINGS

The objects and advantages of the instant invention will become apparent when the specification is read in conjunction with the drawings, wherein.

DETAILED DESCRIPTION OF THE PREFERRED EMBODIMENTS

Figure 1:
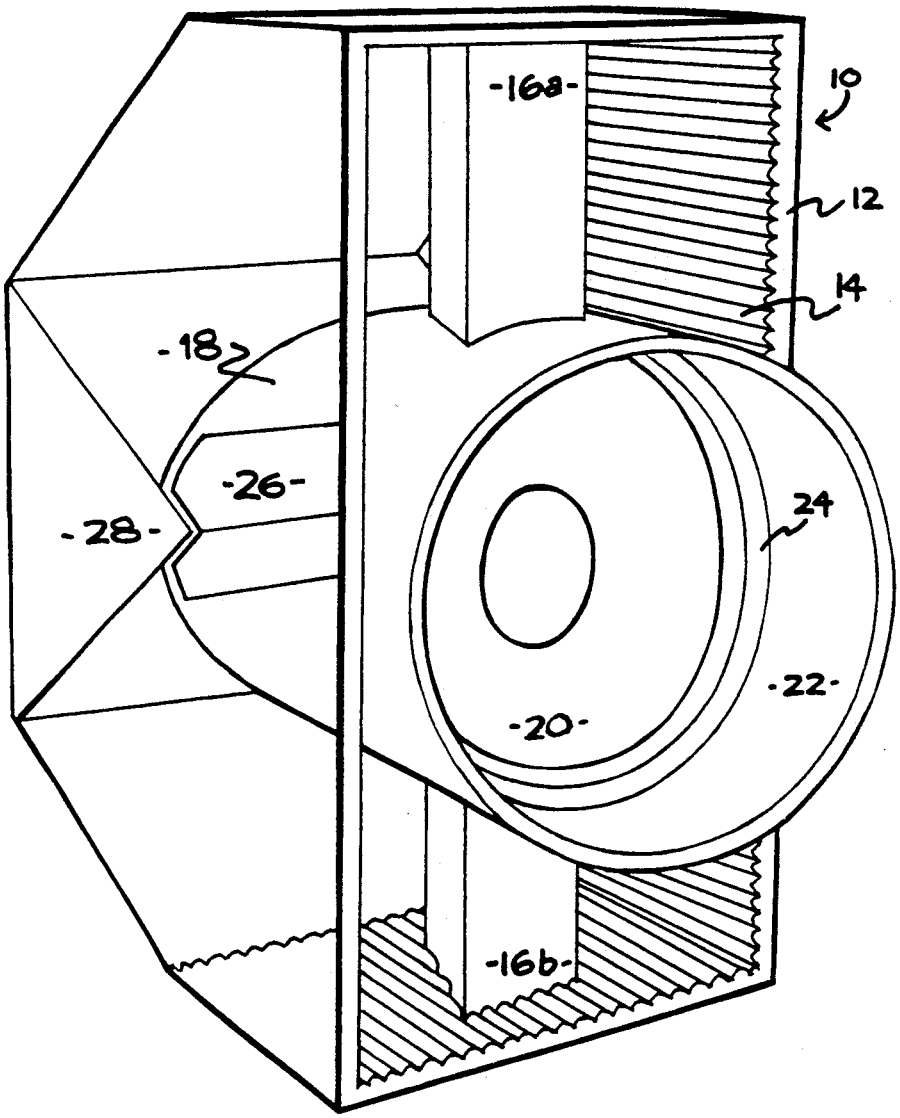
FIG. 1 is a cutaway perspective view of the acoustical enclosure system.

FIG. 1 illustrates the speaker 10 with the sides cut away to reveal the interior. The enclosure 12 can be built from any dense material, however the core of the speaker construction must be dense in order to be reflective on all internal surfaces or secondarily have the ability to capture and stop a base wave by preventing stray non directional waves. No insulation is used within the enclosure 12 as the various wave guides and baffles serve to direct and boost dBSPL performance and overall directionality, as well as direct through reflection the sound in the desired direction. The design of the instant device provides a higher degree of directionality under 90 cycles than conventional enclosure designs. As the cycles increase, so does the directionality since the higher the frequency, the greater the directionality, with the lower frequencies being more difficult to direct. Homosote TM, a material using paper dust and glue made into boards, is an example of a light weight material which meets the criteria for building the interior or core of the enclosure 12. The exterior of the enclosure 12 can be covered with any durable material which will not crack or chip under abusive road use. The forward plane wave guides 14 are used to line the interior forward planes of the enclosure 12 and directs or channels the waves to attain a high degree of directionality before final release from the enclosure 12. The forward plane wave guides 14 can be varied in height and width, and separation to control by capturing the various bass frequencies and/or their respective harmonics. The forward baffle 16*a* and 16*b* is used to push the back wave into the forward plane wave guides 14 to the heighten directivity of all frequencies and increases dBSPL performance. The rear back pressure booster baffle, located behind the driver, 18 is used to form or shape the back wave and boost dBSPL.

The tubular forward wave guide 22 houses or contains the driver or transducer 20 and is mounted within the side walls of the forward wave guide 22. With dynamic simulation programs tubular, square and other geometric shapes and configuration can be used to heighten the already present enclosure characteristics. The connection between the tubular forward wave guide 22 and the top forward baffle 16*a* and the bottom forward baffle 16*b* must be secure to prevent vibration of the forward wave guide 22. The driver or transducer 20 is mounted within the forward wave guide 22 through use of a round L shaped aluminum mounting ring 24. The speaker 20 is mounted flush against the raised portion of the L ring 24 and must be removable to allow for repairs. The removal of the speaker 20 can be through a slide out system, hinge, or any other applicable as known in the prior art. By changing the distance between the rear back pressure booster baffle 18 and the driver or transducer 20, variable tuning is possible.

The rear wave form vent 26, located directly behind the driver or transducer 20, determines the release of sound pressure. The rear wave form vent 26 directly corresponds to the size of the rear back pressure booster baffle 18 to increase dBSPL and direct the back wave by pre-forming the backwave wave before it reaches the forward plane wave guides 14.

The wave splitter 28 splits the back wave and assists in pre-forming the wave as well as assisting in boosting the dBSPL performance. The back wave is split to pre-form the wave, through the wave splitter 28 and is then boosted, through use of the rear back pressure booster baffle 18 and rear wave form vent 26. The rear wave form vent 26 allows release of all frequencies and pre-forms the wave. The forward plane wave guides 14 finely, or more specifically, pre-forms the wave to specific frequencies and their respective harmonics. The forward baffle 16*a* and 16*b* assists in directing the wave by pushing or contouring the back wave into forward plane wave guides 14. The forward baffle 16*a* and 16*b* also boosts dBSPL and allows for a more directed release through contouring of the back wave into the forward plane wave guides 14.

All of the internal surfaces of the speaker 10 are solid and reflective to provide the maximum efficiency in the bass frequencies. The size can be varied, however, it is critical to keep all parts "to scale" to achieve the maximum benefit of the instant disclosure. The design can also be varied to make the enclosure 12 smaller on the vertical measurement, however, again all parts must be kept "to scale". Each type of speakers should be built to best suit the type of music being played through them. The enclosure 12 can be constructed for pre-recorded, live or instrumental (bass guitar) applications as the characteristics of each source are different. The speaker design is based on the lowest common denominator harmonic oriented design, i.e. measure the smallest complete usable fragment of a wave and design a enclosure to control and work around those frequencies or their respective harmonics.

By varying the distance of the driver 20 in the forward plane wave guide 14, the enclosure 12 tuning can be changed by up to one full note (or one full step) when using a bass guitar as a sound source. Also the ratios, when the driver is moved from back to front wave and how they interact to affect, projection and performance can be varied by moving the driver 20 forward and backward within the forward wave guide 22.

By changing various angles and distances with a dynamic simulation computer program, directionality, dBSPL output and enclosure tuning can be modified to suit a variety of specific acoustic needs.

What is claimed is:

1. An acoustical transducer enclosure comprising:

a. a multisided enclosure, said multisided enclosure having at least five sides, said at least five sides being a first side, a second side, a third side, a fourth side and at least one back side; said first side, said second side, said third side and said fourth side being affixed to one another to form an enclosure, said enclosure having an interior area and an exterior area;

b. a cylindrical hollow tube, said cylindrical hollow tube having a first end and a second end;

c. transducer means;

d. forward wave guides, said forward wave guides lining said interior area of said enclosure;
e. forward baffles, said forward baffles extending at right angles to said first side and said third side;
f. a rear wave form vent, said rear wave form vent being located on a horizontal plane with said speaker means, at said first end of said cylindrical hollow tube;
g. a rear back pressure booster baffle, said rear back pressure booster baffle being at said first end of said cylindrical hollow tube;
h. a wave splitter, said wave splitter being located proximate said first end of said cylindrical hollow tube
i. a pair of forward baffles, said forward baffles being at right angles to said first side and said second side.

2. The acoustical transducer enclosure of claim 1 further wherein said interior area is lined with forward plane wave guides.

3. The acoustical transducer enclosure of claim 2 wherein said forward plane wave guides are varied in height and width.

4. The acoustical transducer enclosure of claim 1 wherein said forward baffles are delta shaped.

5. The acoustical transducer of claim 4 wherein said cylindrical hollow tube, is placed at right angles between said pair of forward baffles.

6. The acoustical transducer of claim 5 wherein said transducer means is positioned within said cylindrical hollow tube.

7. The acoustical transducer of claim 6 further comprising mounting means, said mounting means locking said transducer means within said cylindrical hollow tube.

8. The acoustical transducer enclosure of claim 1 wherein said at least one back side forms at least half a polygon.

9. The method of directing sound waves comprising:
an acoustical transducer enclosure, said acoustical transducer enclosure having;
a. a multisided enclosure, said multisided enclosure having at least five sides, said at least five sides being a first side, a second side, a third side, a fourth side; and at least one back side, said first side, said second side, said third side and said fourth side being affixed to one another to form an enclosure, said enclosure having an interior area and an exterior area;
b. a cylindrical hollow tube, said cylindrical hollow tube having a first end and a second end;
c. transducer means,
d. forward wave guides, said forward wave guides lining said interior area of said enclosure;
e. forward baffles, said forward baffles extending at right angles to said first side and said third side;
f. a rear wave form vent, said rear wave form vent being located on a horizontal plane with said speaker means, at said first end of said cylindrical hollow tube;
g. a rear back pressure booster baffle, said rear back pressure booster baffle being at said first end of said cylindrical hollow tube;
h. a wave splitter, said wave splitter being located proximate said first end of said cylindrical hollow tube; and
i. a pair of forward baffles, said forward baffles being at right angles to said first side and said second side.

10. The method of directing sound waves of claim 9 wherein said forward wave guides direct the waves to a high degree of directionality and increase dBSPL performance.

11. The method of directing sound waves of claim 10 wherein said forward wave guides can be varied in height and width to control the frequencies and subsequent harmonics.

12. The method of directing sound waves of claim 9 wherein said rear wave form vent corresponds directly to the size of the rear back pressure booster baffle.

13. The method of directing sound waves of claim 9 wherein said rear back pressure booster baffle and said rear wave form vent direct the back wave by pre-forming the backwave wave prior to said backwave wave reaching said wave splitter and said forward plane wave guides, thereby increasing dBSPLs performance.

14. The method of directing sound waves of claim 9 wherein backwaves are split by said wave splitter to pre-form said backwave subsequent to said backwaves having been increased by said rear back pressure booster baffle and said rear wave forward vent.

15. The method of directing sound waves of claim 9 wherein the directivity of all frequencies are heightened and dBSPL performance is heightened when waves are pushed into the forward plane wave guides.

16. The method of directing sound waves of claim 9 wherein the tuning can be changed by up to one full note by varying the distance of said speaker means within said cylindrical hollow tube.

17. The method of directing sound waves of claim 9 wherein said forward baffles are delta shaped.

* * * * *